US005175501A

United States Patent [19]

Loewe et al.

[11] Patent Number: 5,175,501

[45] Date of Patent: Dec. 29, 1992

[54] METHOD OF DERIVING A PRIMARY CLOCK FROM SECONDARY SIGNALS IN A DISTRIBUTORLESS IGNITION SYSTEM

[75] Inventors: Thomas D. Loewe, Wonder Lake; David M. Oles, Hanover Park, both of Ill.

[73] Assignee: Sun Electric Corporation, Crystal Lake, Ill.

[21] Appl. No.: 651,077

[22] Filed: Feb. 6, 1991

[51] Int. Cl.[5] ..... F02P 17/00

[52] U.S. Cl. ..... 324/380; 324/402; 324/393

[58] Field of Search ..... 324/380, 379, 384, 393, 324/397, 402; 73/116, 119 R

[56] References Cited

U.S. PATENT DOCUMENTS 4,847,563 7/1989 Sniegowski et al. ..... 324/402
4,937,527 6/1990 Saniegowski et al. ..... 324/393
5,068,613 11/1991 Kreft et al. ..... 324/402

*Primary Examiner*—Jack B. Harvey
*Assistant Examiner*—Maura K. Regan
*Attorney, Agent, or Firm*—Nicholas A. Camasto

[57] ABSTRACT

An interface for coupling an engine analyzer to an engine having a distributorless ignition system includes a pair of pickup clamps for coupling signals from respective groups of spark plug wires. A logic cell array is supplied with spark plug secondary voltage polarity and pattern information, corresponding to an engine under test from a ROM. The technician is instructed as to which wires to place in each clamp. A semiconductor input switch is controlled by the logic cell array to sort the secondary voltages from the pickup clamps according to polarity. The real and the wasted sparks are then determined based upon the magnitude of the signals from the input switch. The apparatus permits a "rapid test" (of secondary voltages only) by developing a pseudo #1 primary clock from the pickup clamp signals. A CPU in the interface is controllable by an external computer or by an operator keypad. A vehicle "personality" module interfaces the logic cell array with the voltage levels on a connector of a corresponding vehicle.

5 Claims, 2 Drawing Sheets

METHOD OF DERIVING A PRIMARY CLOCK FROM SECONDARY SIGNALS IN A DISTRIBUTORLESS IGNITION SYSTEM

CROSS REFERENCE TO RELATED APPLICATIONS

This invention utilizes apparatus described and claimed in copending applications Ser. No. 256,168, filed Oct. 11, 1988, entitled METHOD AND APPARATUS FOR GENERATING DISPLAY WAVEFORMS IN WASTED SPARK IGNITION SYSTEMS, in the names of K. A. Kreft, M. Dikopf and T. D. Loewe, now U.S. Pat. No. 5,068,613, issued Nov. 26, 1991, and is related to application Ser. No. 651,667, filed Feb. 6, 1991, entitled INTERFACE FOR COUPLING AN ANALYZER TO A DISTRIBUTORLESS IGNITION SYSTEM, in the name(s) of T. D. Loewe and D. M. Oles, all of which are assigned to Sun Electric Corporation.

BACKGROUND OF THE INVENTION AND PRIOR ART

This invention relates generally to ignition analyzers for automotive engines and particularly to an interface unit for coupling an ignition analyzer, such as the Sun Electric Corporation Model MCA 3000, to automotive engines having distributorless ignition systems.

In distributorless ignition systems, individual pairs of spark plugs are connected by a common ignition coil and are fired simultaneously, with one spark plug firing resulting in a real firing event and the other plug firing resulting in a wasted firing event. The real firing event occurs on the compression stroke. The wasted firing event occurs on the exhaust stroke and contributes no power to the engine. With the arrangement, a single ignition coil is used for each pair of spark plugs which are fired with opposite polarity voltages. The voltage during the wasted firing event is typically one third of the real firing event voltage. For a four cylinder engine, two individual ignition coils are required and for a six cylinder engine, three are required. A major difficulty is that it is not readily known whether a spark plug experiences a real firing event or a wasted firing event since each spark plug is fired during both the compression and the exhaust strokes of each engine cylinder cycle. The above-mentioned U.S. Pat. No. 5,068,613 describes a system that determines the real and wasted firing events by using a pair of pickup clamps, each of which is coupled to the spark plug wires having secondary voltages of like polarity, in conjunction with a #1 cylinder secondary pickup clamp.

Difficulties often arise because of the crowded conditions under the hood of a modern day automobile and because of the engine design. Often it is not possible to access all of the spark plug wires of like polarity with a single pickup clamp. In the system described in U.S. Pat. No. 5,068,613 No. mentioned above, the two pickup clamps are designed to couple spark plug wires having the same signal polarity. In an automobile engine where that is physically impossible with the pickup clamps, the invention in copending application Ser. No. 651,677 solves the need.

With that invention, the engine type is entered into the interface unit via a keypad. A so-called vehicle personality module or card is installed to interconnect with the vehicle connector. The personality module provides level matching for signals going between the vehicle and a logic cell array (LCA). The LCA is in communication with a ROM memory that stores spark plug polarity and pattern information for a variety of different engines, configures a solid state input switch such that an appropriate polarity signal is outputted for a particular spark plug wire, irrespective of the signal input polarity received by the signal pickup clamp. The particular wires that are to be grouped in each pickup clamp are identified for the technician via a display device. A #1 cylinder pickup clamp is installed on the #1 cylinder spark plug wire and provides #1 cylinder clock information to the LCA. In situations where the #1 cylinder spark plug wire is inaccessible, the operator may select any other cylinder to trigger on. This is accomplished via a keypad entry. As mentioned, in accordance with U.S. Pat. No. 5,068,613, the secondary signals are sorted into wasted and real firing event groups and the real firing event (power) #1 signal is determined. Thus the interface of that invention permits the engine analyzer to be used with distributorless ignition systems of many different types.

The present invention is specifically concerned with performing, in a fairly rapid manner, secondary only tests on an engine. Often such tests are sufficient to determine engine operating conditions without requiring detailed under-the-hood hook ups and specialized engine information. In such a test, the vehicle connector and the personality module are not used. Consequently, there is no primary clock signal, such as an "EST" or "spout" signal, to drive the LCA logic array. The present invention derives a "pseudo" primary clock from the secondary waveforms for driving the LCA logic to determine the real and the wasted firing event secondary signals.

OBJECTS OF THE INVENTION

A principal object of the invention is to provide a novel arrangement for conducting secondary waveform tests on a distributorless ignition system.

Another object of the invention is to provide an analyzer interface that develops a pseudo primary clock to simplify engine testing.

A further object of the invention is to provide an interface for a distributorless ignition system and an engine analyzer that does not require any connections to the vehicle computer or primary ignition system.

BRIEF DESCRIPTION OF THE DRAWINGS

These and other objects and advantages of the invention will be apparent upon reading the following description in conjunction with the drawings, FIGS. 1A and 1B of which are of a simplified block diagram of the invention interface coupled to a distributorless ignition system.

DESCRIPTION OF THE PREFERRED EMBODIMENT

Figure 1A:
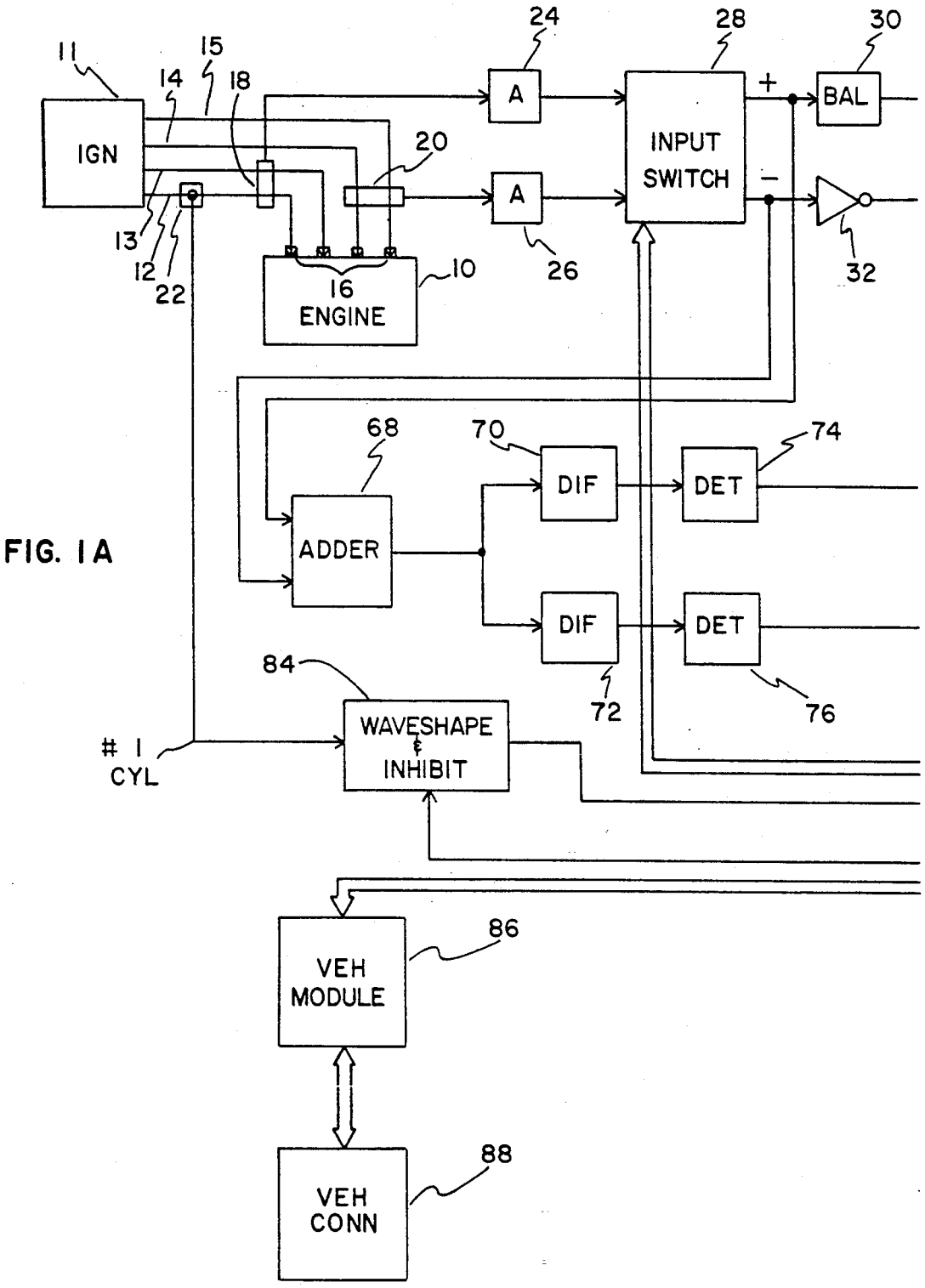
Figure 1B:
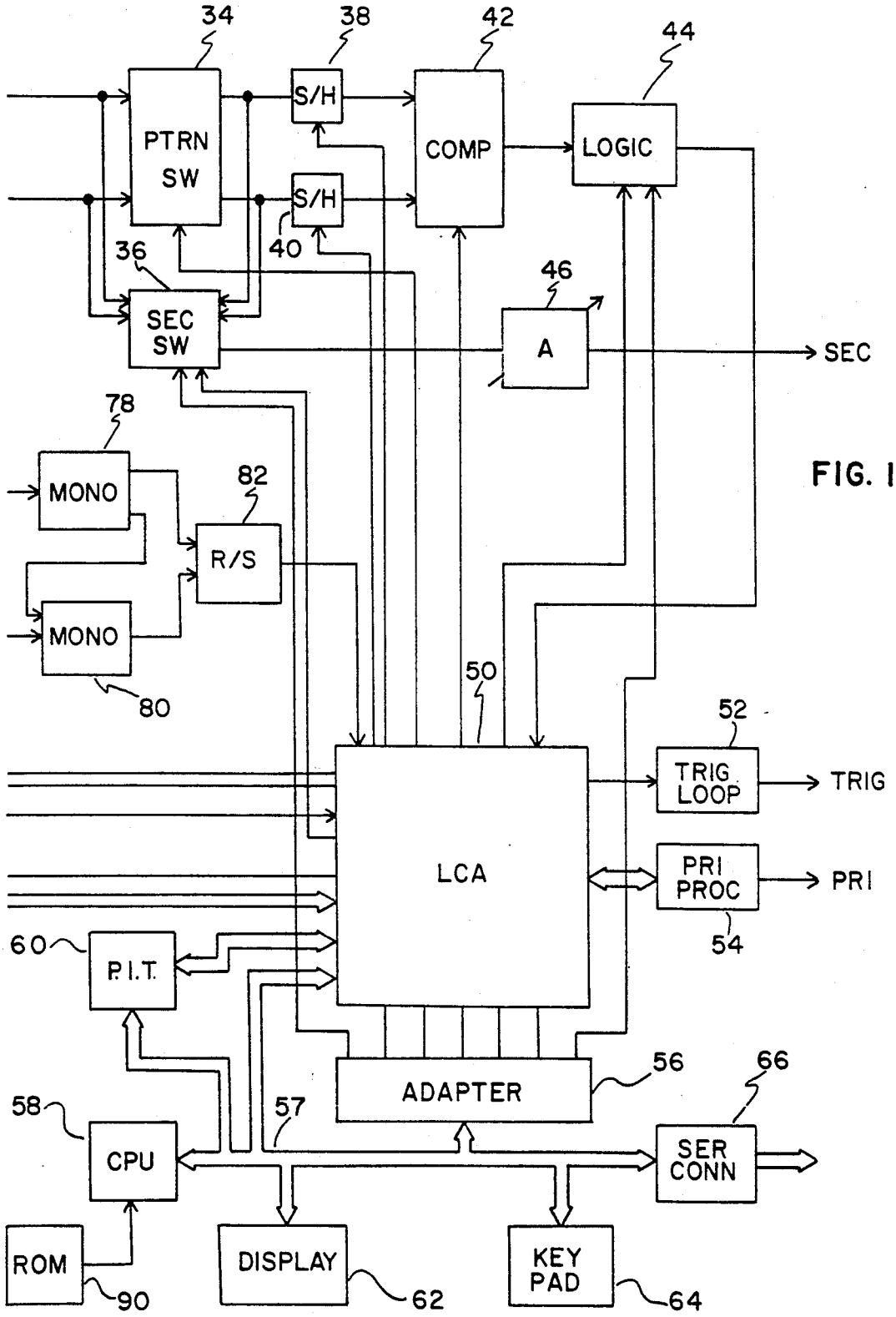

Referring to the drawing, an engine 10, illustrated as having four cylinders, has an associated distributorless ignition system 11 that supplies secondary or firing voltages, via a plurality of spark plug wires 12, 13, 14 and 15, to corresponding ones of a group of four spark plugs 16. A pair of secondary voltage pickup clamps 18 and 20 is provided, with each clamp encircling a pair of spark plug wires and responding to secondary voltage signals thereon. A cylinder #1 pickup clamp 22 is coupled to the #1 spark plug wire on engine 10 for picking up the #1 cylinder secondary voltage. Secondary pickup clamp 18 is coupled to a buffer amplifier 24 and secondary pickup clamp 20 is coupled to a buffer amplifier 26. The outputs of the buffer amplifiers are coupled to a semiconductor input switch 28 which produces a pair of outputs, one having all of the positive polarity firing event signals which are supplied to a balance amplifier 30 and the other having all of the negative polarity firing event signals which are supplied to an inverter 32. Balance amplifier 30 is a variable gain amplifier that balances the levels of the signals from input switch 28 since some are processed by inverter 32. The outputs of balance amplifier 30 and inverter 32 (both positive) are coupled to a pattern switch 34 and to a secondary waveform switch 36. The outputs of pattern switch 34 are also coupled to secondary waveform switch 36 and to a pair of sample-and-hold circuits 38 and 40, respectively. The sample-and-hold circuits function to elongate or stretch out the very short duration secondary ignition voltages from pattern switch 34. The sample-and-hold circuits 38 and 40 are in turn coupled to a comparator 42 which develops an output that reflects the largest amplitude signal. The output of comparator 42 is applied to a logic arrangement 44. The output of secondary waveform switch 36 supplies a variable gain amplifier 46, the output of which provides the secondary waveforms to an engine analyzer (not shown).

The programmable logic cell array includes a plurality of input and output connections and is coupled to logic circuit 44. LCA 50 is readily available "off-the-shelf" under the designation XILINX PRE 2064. LCA 50 is also coupled to input switch 28, to pattern switch 34, to secondary waveform switch 36 and to comparator 42. The #1 cylinder clock signal is applied through a wave shape circuit 84 to LCA 50. LCA 50 obtains a timing clock, corresponding to the #1 cylinder signal (or other selected cylinder) from waveshape circuit 84. As fully disclosed in the above-mentioned U.S. Pat. No. 5,068,613 the real and wasted firing events are determined based upon the magnitude of the signals from pattern switch 34 and coordinated with the #1 cylinder signal so that the real and wasted firing event signals are all determined by LCA 50. LCA 50 outputs a signal corresponding to the real #1 cylinder firing event to a trigger loop circuit 52 which provides the trigger signal for the engine analyzer. LCA 50 is also in communication with a primary signal process 54 which is coupled to the primary signal processing circuitry of the engine analyzer. An adapter 56 is coupled to LCA 50 and communicates with a bidirectional bus 57. Adapter 56 is commonly referred to as VIA (versatile interface adapter) and is an IC of the type RC 522. The bus 57 in turn is coupled to a microprocessor control unit (CPU) 58, a programmable interval timer 60, a display device 62, a user-operated keypad 64 and a serial communications arrangement 66, the latter of which permits communications with the host engine analyzer or other computer. CPU 58 is coupled to LCA 50, as is programmable interval timer 60. A ROM 90 is accessible to CPU 58 and includes the spark plug location and signal polarity information for each of the various engine types. As mentioned, this information is made available to LCA 50 via CPU 58 and keypad 64. Lastly, the vehicle personality module is coupled to LCA 50. As mentioned, this module is adapted to be interconnected with a vehicle connector 88 that is resident on the particular vehicle under test. The vehicle personality module may contain information particular to the particular vehicle, group of vehicles or type of vehicle and may be used by the technician to obviate the entry of engine type data into LCA 50 via the keypad. In the preferred embodiment, the personality module contains interface circuitry for coupling signals between the vehicle and LCA. The personality module is capable of an enhanced degree of automation to the engine analysis process and, in the preferred embodiment, enables the MCA 3000 to perform comprehensive tests on the engine.

The separate rapid test circuit feature of the present invention is shown for conducting secondary only testing operations relatively quickly. The rapid test sequence is automatically accessed in the absence of a vehicle personality module. Such a test, in which the secondary waveforms are viewed and analyzed, provides a gross analysis of engine performance and may obviate more detailed tests or point out particular tests that should be performed. In the rapid test only the secondary pickup clamps 18 and 20 and the trigger pickup clamp 22 are installed (along with a batter connection, not shown). This arrangement consists of an adder 68 that is supplied with the outputs of the input switch 28 and, which in turn, supplies a pair of differentiators 70 and 72. The outputs of the differentiators are applied to respective threshold detectors 74 and 76 which supply respective monostables 78 and 80. One output of monostable 78 is also supplied as an input to monostable 80. The monostable outputs are applied to the R and S inputs of an RS flip-flop 82, the output of which is coupled to LCA 50. The purpose of this arrangement is to develop a pseudo primary "points open" and "points closed" clock signal to drive the digital logic circuitry since LCA 50, in the rapid test arrangement, is not provided with any primary information. The pseudo clock signal enables the LCA to determined the real and wasted sparks and therefore to perform very fundamental secondary voltage checks to determine the gross operating parameters of the engine.

A pair of square wave pulses is developed by detectors 74 and 76. The monostables have different timing cycles, with monostable 78 being about 2.4 ms and monostable 80 being about 1.15 ms. The 2.4 ms square wave is used to block the negative pulse resulting from ringing of the secondary firing event waveform.

What is claimed is:

1. A method of deriving a primary clock from secondary signals in a distributorless ignition system, comprising:

obtaining real and wasted firing event secondary signals, including a #1 cylinder secondary signal, from pairs of spark plugs that are connected to opposite ends of an ignition coil;

combining the real and wasted signals to develop combined secondary signals;

processing the combined secondary signals to develop a pair of square wave pulses;

applying the pair of square wave pulses to a flip-flop; and applying the output of the flip-flop as a primary clock for controlling logic circuitry to determine which are the wasted and which are the real firing event secondary signals.

2. The method of claim 1 wherein said processing step includes differentiating said combined secondary signals to develop said pair of square wave pulses and utilizing one of said pair of square wave pulses for noise immunity.

3. The method of claim 2 wherein a pair of threshold detectors accept said pair of square wave pulses and wherein a pair of interconnected monostables is supplied with the outputs of said threshold detectors.

4. A method of deriving a primary clock from secondary signals in a distributorless ignition system producing a real and a wasted firing even for each ignition pulse comprising:

sensing first and second secondary signals, corresponding to pairs of spark plugs, the spark plugs in each pair of spark plugs being coupled to opposite ends of respective individual ignition coils, and including a #1 cylinder secondary signal, in two pickup clamps;

combining said first and second secondary signals from said two pickup clamps;

differentiating said combined signals and applying them to positive and negative threshold detectors;

applying the outputs of the threshold detectors to a pair of corresponding monostables to form corresponding pulses;

applying said corresponding pulses to the input terminals of an RS flip-flop; and applying the output of the RS flip-flop as a primary clock to control logic circuitry for determining the real and the wasted firing events.

5. The method of claim 4 wherein said monostables have different timing cycles with the longer timing cycle being used to block the effects of ringing in the secondary firing event.

* * * * *

UNITED STATES PATENT AND TRADEMARK OFFICE

CERTIFICATE OF CORRECTION

PATENT NO. : 5,175,501

DATED : December 29, 1992

INVENTOR(S) : Thomas D. Loewe and David M. Oles

It is certified that error appears in the above-identified patent and that said Letters Patent is hereby corrected as shown below:

Column 1, line 15, delete "651,667", insert --651,677--;

line 58, delete "No." (second occurrence);

Column 4, line 23, delete "batter", insert --battery--.

Signed and Sealed this

Fourteenth Day of December, 1993

*Attest:*

*Attesting Officer*

BRUCE LEHMAN

*Commissioner of Patents and Trademarks*